US005260112A

United States Patent [19]

Grether, deceased et al.

[11] Patent Number: 5,260,112

[45] Date of Patent: Nov. 9, 1993

[54] COMPOUND GLASS ELEMENT

[75] Inventors: Paul W. Grether, deceased, late of Seuzach, Sweden, by Edith née Höhring Grether; Tina Grether, heir, Kollbrunn; Moritz Grether-Escher, heir, Wintertur; Michael Grether, heir, Seuzach, all of Switzerland

[73] Assignee: Geilinger AG, Winterhur, Switzerland

[21] Appl. No.: 743,017

[22] Filed: Aug. 9, 1991

[30] Foreign Application Priority Data

Aug. 10, 1990 [CH] Switzerland ..... 2611/90

[51] Int. Cl.[5] ..... E06B 3/24

[52] U.S. Cl. ..... 428/34; 428/192; 52/788; 52/790

[58] Field of Search ..... 428/34, 192; 156/107, 156/109; 52/788, 790

[56] References Cited

U.S. PATENT DOCUMENTS

| | | | |
|---|---|---|---|
| 2,306,327 | 12/1942 | Baldwin et al. | 20/56.5 |
| 2,340,469 | 2/1944 | Hall | 20/56.5 |
| 2,369,350 | 2/1945 | Naven | 428/34 |
| 2,838,810 | 6/1958 | Englehart | 20/56.5 |
| 3,537,944 | 11/1970 | Grubb et al. | 428/34 |
| 3,957,406 | 5/1976 | Battersby | 425/87 |
| 4,109,431 | 8/1978 | Mazzoni et al. | 428/34 |
| 4,658,553 | 4/1987 | Shinagaua | 428/34 |
| 4,831,799 | 5/1989 | Glover et al. | 52/172 |

*Primary Examiner*—Donald J. Loney

*Attorney, Agent, or Firm*—Tarolli, Sundheim & Covell

[57] ABSTRACT

In an edge connection for the panes (1, 2) of a compound glass element there is provided a spacing profile (3) which preferably consists of a poorly heat-conductive plastic material. This is adhered between the panes with a contact adhesive (4). As a vapour-barrier, a band (5) of a thin flat metal foil is applied around the exterior of the spacing profile. The outer surface (3.1) of the spacing profile is inwardly offset with respect to the flat metal band in the edge regions adjacent the panes, in such a way that peripherally running chambers (6) are created. These chambers are filled with a vapour-proof adhesive, preferably butyl-adhesive.

10 Claims, 1 Drawing Sheet

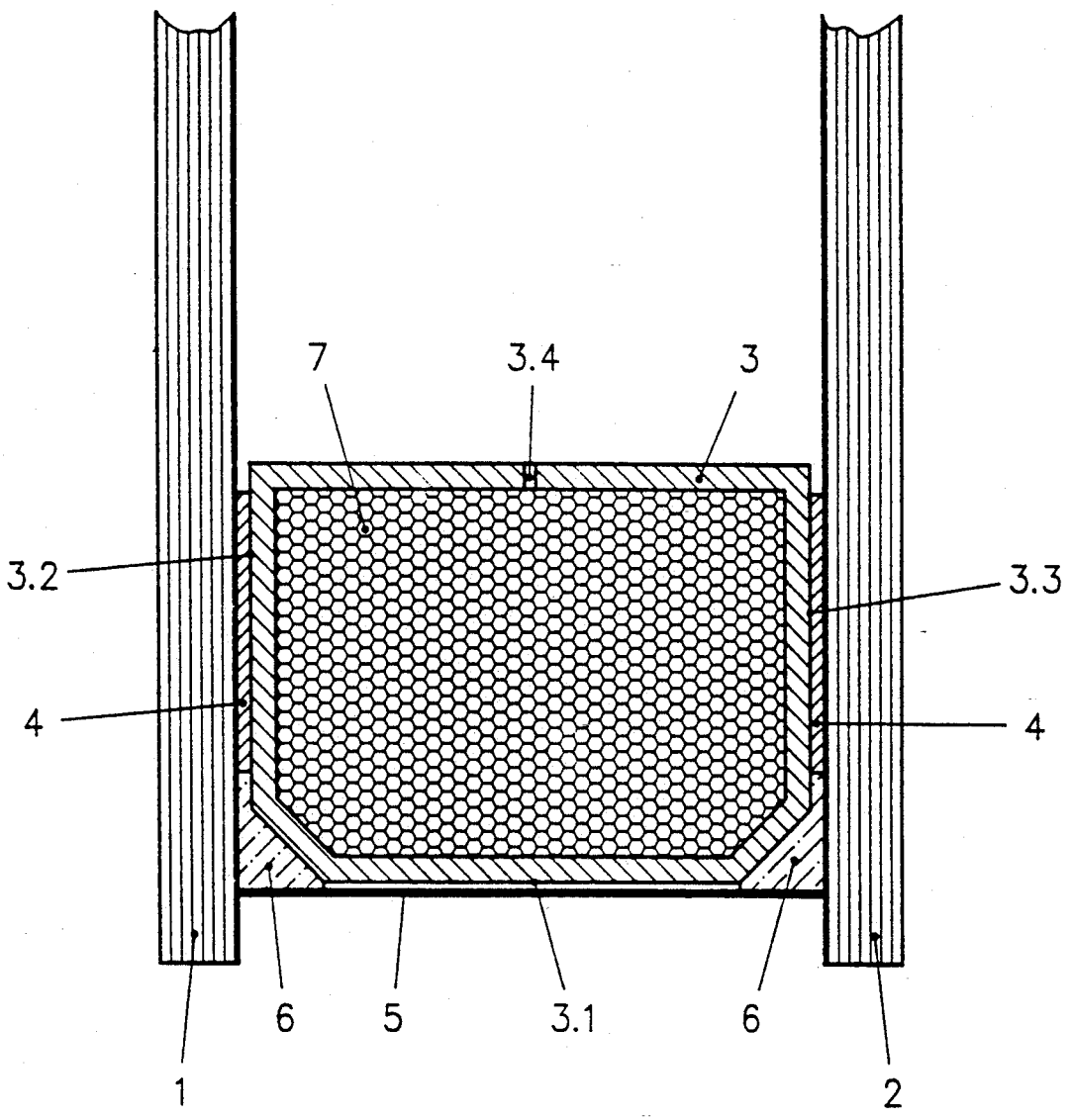
7
3.4
3
3.2
3.3
4
4
6
5
3.1
6
1
2

COMPOUND GLASS ELEMENT

TECHNICAL AREA

This invention relates to a compound glass element with an edge binding member which holds two glass panes in a separated, parallel condition, and which seals the space between the panes from the exterior, in which a spacing profile that includes an external wall as well as side contact surfaces against the panes is located entirely between the panes, the joints between the spacing profile and the glass panes being sealed with the use of a highly vapour-proof adhesive, and a metal foil being applied against the exterior of the spacing profile as an additional vapour barrier.

Regarding the edge binding member for compound glass elements, the following requirements are especially set out:

1. It must guarantee a sufficiently stable mechanical bond between the panes;
2. It must be sufficiently vapour-tight to prevent the penetration of vapour between the panes and the consequent fogging up of the inner surfaces of the panes;
3. It should not provide a thermal bridge between the panes; thus, at the very least it should not be significantly less thermally insulative than the compound glass element over the rest of its surface;
4. It should be capable of simple and economical manufacture.

STATE OF ART

The solutions that have become known up to now meet only some of the above-named requirements.

For example, from EP, A2, 0 127 739 there is known a spacing profile for a compound glass element within the above named category. It is a rectangular, coextruded profile made of glass fibre reinforced polypropylene, together with lateral sealing lips and sealing beads. The sealing beads are responsible for the gripping and sealing of the panes and are made of butyl. After metal and glass, butyl is the material with the best vapourproofing qualities. Exteriorly, the profile is covered with a metal foil in order to increase its waterproofing ability. Thermotechnically the known solution is good, since the plastic material used is a poor heat conductor, and does not provide a thermal bridge between the panes. The thermal conductance of the thin metal foil can be ignored. Although the low vapourproofing quality of the plastic material of the spacing profile is increased by the metal foil, weak points arise particularly in the corners where the profile is connected together. Other weak points with regard to sealing capability are found in the contact locations between the metal foil and the panes. At the most, only a small-surface mutual contact between the metal foil and the butyl is attained there. Because of the substantial tendency of butyl to creep, the result for the compound glass element as a whole is only a minimal mechanical stability. This interferes with ease of handling of the element during manufacture, during transport, and during installation, and requires that the unit be provided with additional mechanical stabilization where it is being installed, for example in a window casement. Finally, the manufacture of the spacing profile is rather costly.

From DE, Al, 31 35 973 it is known to adhere plastic spacing profiles between the panes of compound glass elements using butyl rubber, in such a way that the spacing profile is enclosed entirely by butyl rubber on the exterior. The exterior of the spacing profile is constructed so as to be inwardly offset at the edge region adjacent the panes. This known solution is technically relatively simple from a manufacturing viewpoint, and is also acceptable in terms of thermal characteristics. The vapour barrier, however, which in practical terms is constituted only by the butyl rubber, is relatively weak. Because of the substantial creep tendency of butyl, the mechanical bond is also weak. With this known solution, a particularly disadvantageous characteristic arises from the fact the butyl rubber does not lose its stickiness over time. The known compound glass element therefore exhibits a permanently sticky edge at the externally lying butyl rubber layer. It therefore can easily become stuck, for example, when it must be set down on its edge during transport or during installation.

From DE, C3, 24 54 530 there is known an edge profile made of thermolplastic material for a compound glass element, which grips the panes from the outside and therefore holds them together quite well. A separate spacing profile holds the panes in spaced relation. The space between the edge profile and the spacing profile is filled with a sealing compound of polysulphide rubber. A vapour seal of butyl rubber is provided only between the panes and the spacing profile. The vapour penetrability of the edge profile, the specified sealing compound and the spacing profile is not dealt with.

DESCRIPTION OF THE INVENTION

The aim of the invention is to provide a compound glass element of the above specified kind, which fully satisfies the previously named requirements taken together. In accordance with the invention, this aim is attained in a compound glass element with the characteristics of a metal foil applied as a flat band over abutment locations of a spacing profile and which encircles the spacing profile on the exterior. The exterior of the spacing profile at edge regions adjacent the panes is inwardly offset with respect to the flat metal band in such a way that peripherally running chambers are defined between the spacing profile, the panes and the metal band. The chambers are filled with a highly vapor-proof adhesive. The panes are adhered to the lateral contact surfaces of the spacing profile by means of a lesser vapor-proof adhesive with a lower tendency to creep and which by itself ensures the mechanical bond between the spacing profile and the panes. Accordingly, the compound window in accordance with the invention is firstly characterized in that the metal foil is provided as a flat band encircling the spacing profile at abutment locations thereof on the exterior, and is joined together at only a single location. The exterior of the spacing profile, at the edge regions bordering on the panes, is formed in an inwardly offset manner with respect to the flat metal band such that peripherally extending chambers are created between the spacing profile, the panes and the metal band. These chambers receive the highly vapour-proof adhesive. The compound window in accordance with the invention is further characterized in that the panes are adhered to the lateral contact surfaces of the spacing profile by means of a less vapour-proof adhesive with a lower tendency to creep and which provides only the mechanical bond between the spacing profile and the panes.

Advantageous and preferred embodiments of the invention are characterized in the dependent claims. In particular, if the spacing profile is made of a plastic of low thermal conductivity and the metal band has a thickness of only approximately 1/10 mm and is made of a material with a low thermal conductivity, such as austenitic steel for example, the result is a good thermally insulative edge connection, such as that required for the so-called heat protective glazing, with a K-value smaller than approximately 1.4 watts per square meter and degree Kelvin. In this construction, the edge connector unit has sufficient thermal insulative properties even for compound glass elements with a K-value small than about 0.8 watts per square meter and degree Kelvin, for example those with a spacing between the panes larger than 50 mm and/or with additional stretched films between the panes.

BRIEF DESCRIPTION OF THE DRAWING

An example embodiment of the invention is described below in connection with the drawing. This shows in a single figure and in section the edge bond of a compound glass element in accordance with this invention.

DETAILED DESCRIPTION OF THE INVENTION

In the figure, numerals 1 and 2 designate two glass panes held in spaced-apart condition and parallel to each other by a spacing profile 3. The spacing profile 3 is somewhat rectangular in section and includes a flat outer surface 3.1 as well as flat lateral contact surfaces 3.2 and 3.3.

The panes 1 and 2 are adhered to the lateral contact surfaces 3.2 and 3.3 using an acrylate contact adhesive layer 4. This adhesion is sufficiently strong and ensures by itself the mechanical bond for the panes.

Against the outer surface 3.1 at the exterior of the spacing profile 3 there is provided, as a vapour barrier, a flat band 5 made of a thin, roughly 0.1 mm thick, foil of non-rusting austenitic steel. The band 5 is of a width such that it extends across the entire distance between the panes 1, 2. Although it cannot be seen in the selected sectional drawing, the band extends around the entire compound glass element, which in plan view may for example be rectangular, and the band is preferably joined together in a somewhat overlapping manner only at one junction location.

The outer surface 3.1 of the spacing profile 3 is inwardly offset with respect to the flat metal band 5 at the edge regions bordering on the panes, such that peripheral chambers 6 are created between the spacing profile 3, the panes 1, 2 and the metal band 5. The chambers 6 are filled with a highly vapour-proof hot-melt-butyl adhesive. The latter does not need to contribute to the mechanical bond between the two panes 1 and 2 and the spacing profile 3. It merely must support the metal band 5.

The band 5 is held by the butyl adhesive in the chamber 6 only in the edge regions adjacent panes 1, 2. Between these edge regions, the band lies loosely against the outer surface 3.1 of the spacing profile 3.

The butyl adhesive primarily seals, in a vapour-proof manner, the small cracks between the band 5 and the panes 1, 2. Because of the large surface contact of the butyl adhesive with the metal band 5, the panes 1, 2 and the spacing profile 3, this being due to the configuration of the spacing profile 3 in the edge zones adjacent the panes 1 and 2, an excellent sealing effect is attained.

As is illustrated in the figure, the interior space of the spacing profile 3 can be filled, in known manner, with a drying substance 7 which eventually binds any remaining moisture still located in the space between the panes. This requires that the just mentioned interior space in the spacing profile 3 be in communication through small bores 3.4 with the space between the panes.

Because the vapour-proof quality is already adequately ensured by the metal band 5 and the described manner of adhering it, neither the spacing profile nor the adhesive layers 4 between the spacing profile 3 and the panes 1, 2 need to be vapour-proof. With respect to the adhesive layers 4, this makes possible the use of the already mentioned acrylate contact adhesive, which when compared with the butyl adhesive that is used practically only for sealing purposes, exhibits a substantially higher holding strength. For the spacing profile, the same reasons allow the use of a material, for example a plastic material, which is vapour-penetrable, nonmetallic but poorly heat conductive, and which therefore does not establish a heat bridge between the panes 1 and 2. In this connection however the strongly differing thermal expansion characteristics of plastic and glass should be taken into account, in order not to cause too much shear-stress in the contact adhesive layers. In order to limit any substantial thermal expansion, a fibre reinforced plastic material can for example be used. Alternatively, the spacing profiles can be assembled from a plurality of shorter pieces of non-fibre reinforced plastic with a spacing from one to the other.

The manufacture of a compound glass element of the above described kind, for example one which is rectangular in plan view, is very simple and inexpensive. The contact adhesive layers 4 constituting the supporting adhesive are applied in the form of so-called assembly adhesive bands, covered on the surface with protective film, on the lateral contact surfaces 3.2 and 3.3 of four spacing profiles 3 which are of suitable length, in such a way that the cutting to final length takes place only after the assembly adhesive bands are applied. Then the four spacing profiles 3, after the removal of the protective film of the contact adhesive layer from initially only one contact wall, is adhered, so as to constitute a frame, to one of the two panes 1, 2. In doing this, it is sufficient for the spacing profiles 3 to merely abut at the corners. No mechanical bond is necessary in the corners because of the sufficient holding strength of the contact adhesive layers. Next the protective film covering the contact adhesive layers 4 of the other contact walls of the spacing profile 3 is removed, and the second pane is adhered thereagainst.

Advantageously, the contact adhesive bonds 4 develop their full holding strength immediately upon contact with the various pieces. In this manner no disadvantageous time lags arise during the manufacture, as is the case with other adhesives which are such that one must wait for them to harden.

The butyl adhesive is now placed into the still outwardly open chambers 6, and subsequently the metal band 5 is wrapped round the exterior of the entire compound glass element. The metal band can be withdrawn metal band 5 is so applied that its two ends overlap not at a corner but rather at a long edge of the compound glass element, and are there easily adhered to one another in an overlapping manner.

The embodiments of the invention in which an exclusive property or privilege is claimed are defined as follows:

1. A compound glass element comprising:

two glass panes (1, 2) in spaced, parallel orientation;

a spacing profile, which is positioned entirely between said panes for keeping said panes in spaced, parallel orientation and separates the space between said panes from the exterior, said spacing profile (3) having an exterior wall (3.1) as well as lateral contact surfaces (3.2, 3.3) abutting against said panes, whereby said spacing profile is joined to said panes with said contact surfaces; and a metal foil (5) which surrounds said spacing profile's exterior surface as an additional vapor barrier;

wherein said metal foil is a flat band which lies entirely between said panes and abuts against each of said panes in a respective butt joint;

said exterior wall of said spacing profile at the edge regions adjacent said panes is inwardly offset with respect to said metal foil in such a way that peripherally running sealing chambers (6) for said butt joints are defined between said spacing profile, said panes and said metal foil;

a first adhesive which is vapor impervious fills, said sealing chambers; and said panes are joined to said lateral contact surfaces of said spacing profile by means of a second adhesive (4) with a low tendency to creep, and which by itself ensures the mechanical bond between said spacing profile and said panes.

2. A compound glass element according to claim 1, characterized in that the first adhesive is a hot-melt-butyl adhesive.

3. A compound glass element according to claim 2, characterized in that the second adhesive which ensures the mechanical bond between the spacing profile and the panes is an acrylate contact adhesive.

4. A compound glass element according to one of claim 1, 2 or 3, characterized in that the spacing profile is made of plastic.

5. A compound glass element according to one of claims 1, 2 or 3, characterized in that the metal band has a thickness of approximately 0.1 mm. and is made of austenitic steel.

6. A thermally insulative compound window unit, said unit comprising;

first and second glass panes; and an edge connector for holding said first and second panes in a spaced, parallel orientation and for sealing a space between said first and second panes from the exterior environment, said edge connector comprising a spacer element positioned between said first and second panes adjacent outer edges of said first and second panes for spacing the panes apart, said spacer element having an inner surface defining the space between said first and second panes, first and second side surfaces facing said first and second panes, respectively, an outer surface facing away from the space between said first and second panes, and chamfered shoulder portions positioned on either side of said outer surface of said spacer element and which extend the length of said spacer element adjacent to said first and second panes, adhesive means engaging said first and second panes and said first and second side surfaces of said spacer element for affixing said first and second panes to said spacer element and for preventing creep of said first pane relative to said second pane, a flat metal vapor-impervious band positioned adjacent to said outer surface of said spacer element between said first and second panes and adjacent to the outer edges of said first and second panes for preventing passage of the exterior environment into the space between said first and second panes, said band having an exterior surface exposed to the exterior environment for protecting said edge connector from influences of the exterior environment, and a vapor-impervious sealant for hermetically sealing between said first pane and said band and for hermetically sealing between said second pane and said band, said sealant being located in each area defined by a respective one of said first and second panes, a respective one of said chamfered shoulder portions and an interior surface of said band.

7. A window unit as set forth in claim 6, wherein said band extends in a plane perpendicular to the extent of said first and second panes and lies loosely against said outer surface of said spacer element.

8. A window unit as set forth in claim 7, wherein said band has a thickness, as measured from its interior surface to its exterior surface, of approximately 0.1 mm and is non-rusting austenitic steel.

9. A window unit as set in claim 7, wherein said band has a width which is approximately equal to the width of said spacer element and the adhesive means.

10. A window unit as set forth in claim 7, wherein said band has a width which is approximately equal to the thickness of the space between said first and second panes.

* * * * *

UNITED STATES PATENT AND TRADEMARK OFFICE

CERTIFICATE OF CORRECTION

PATENT NO. : 5,260,112

DATED : November 9, 1993

INVENTOR(S) : Paul W. Grether, Edith Hohring Grether, Tina Grether, Moritz Grether-Escher and Michael Grether It is certified that error appears in the above-identified patent and that said Letters Patent is hereby corrected as shown below:

Column 5, line 7, after "in" insert --said--.

Signed and Sealed this

Tenth Day of May, 1994

Bruce Lehman

*Attest:*

BRUCE LEHMAN

*Attesting Officer*

*Commissioner of Patents and Trademarks*